US006246040B1

(12) United States Patent
Gunn

(10) Patent No.: US 6,246,040 B1
(45) Date of Patent: Jun. 12, 2001

(54) SOLID STATE RF GENERATOR FOR DIELECTRIC HEATING OF FOOD PRODUCTS

(76) Inventor: Bradley R. Gunn, 1735 E. Bayshore Rd., Redwood City, CA (US) 94063

( * ) Notice: Subject to any disclaimer, the term of this patent is extended or adjusted under 35 U.S.C. 154(b) by 0 days.

(21) Appl. No.: 09/347,620

(22) Filed: Jul. 2, 1999

Related U.S. Application Data

(60) Provisional application No. 60/117,941, filed on Jan. 29, 1999.

(51) Int. Cl.[7] ..... H05B 6/46

(52) U.S. Cl. ..... 219/771; 331/46; 99/358; 219/778; 219/780

(58) Field of Search ..... 219/771, 778–780; 99/358; 331/46, 56, 50, 52

(56) References Cited

U.S. PATENT DOCUMENTS 2,546,004 * 3/1951 Kinn ..... 219/778
2,550,584 * 4/1951 Mittelmann ..... 219/771
4,119,826 * 10/1978 Chambley et al. ..... 219/778
4,453,073 * 6/1984 Bredenkamp ..... 219/130.1
5,256,845 * 10/1993 Schippers ..... 219/769
5,834,746 * 11/1998 Pedersen et al. ..... 219/130.1

FOREIGN PATENT DOCUMENTS

2440674 * 7/1980 (FR) .
58-7788 * 1/1983 (JP) .
58-198891 * 11/1983 (JP) .
10-134953 * 5/1998 (JP) .

* cited by examiner

*Primary Examiner*—John A. Jeffery
(74) *Attorney, Agent, or Firm*—Carr & Ferrell, LLP

(57) ABSTRACT

A solid state radio frequency (RF) generator for dielectric heating of food products. In the preferred embodiment, a distributed oscillator comprising an array of solid state devices (e.g., MOSFETs) and a high voltage inductor drives a capacitor to produce an intense alternating electric field. Dielectric materials moving through the field, preferably food products in a glass pipe, are substantially instantaneously, preferentially, and uniformly heated by the field. Operators of the heater may observe the process, and may incorporate a number of heating stages into a food processing system having an easily controllable temperature profile. The use of a large number of individual low-cost low-power devices increases the reliability and ease of maintenance of the generator. Each coil turn of the inductor is shunted by a tuning capacitor to evenly distribute the load across all inductor coil turns. Each coil turn is driven by a pair of push-pull series device chains, with each device synchronously driven by individual gate transformers also connected to the coil turn, and with each device shunted by a balancing capacitor to evenly distribute the load across the devices in the chain.

45 Claims, 9 Drawing Sheets

200

SOLID STATE RF GENERATOR FOR DIELECTRIC HEATING OF FOOD PRODUCTS

CROSS-REFERENCE TO RELATED APPLICATION

This application is related to U.S. Provisional Patent Application Ser. No. 60/117,941, entitled "Solid State RF Generator For Dielectric Heating Of Food Products," filed on Jan. 29, 1999, which is incorporated by reference.

BACKGROUND OF THE INVENTION

1. Technical Field

This invention relates generally to dielectric heating systems, and more particularly to solid state radio frequency (RF) generators for dielectric heating of food products.

2. Description of the Background Art

Dielectric heating applies an intense, rapidly alternating electric field to materials to be heated. Electrically asymmetric or polar molecules in the materials to be heated constantly attempt to move and rotate to align themselves with the changing electric field. The electrical agitation of these polar molecules produces heat.

Water absorbs electrical energy in this manner particularly well, so dielectric heaters are often used where preferential heating of water is needed. Examples of these uses include drying paper, wood, ceramics, ink, textiles, and foam. Dielectric heating can also be used for distillation, curing glues, sintering, soil remediation, medical waste sterilization, and freeze-drying.

Dielectric heaters are also used where other means of heating are difficult to implement or have undesirable consequences. For example, contact heating involves application of heat to a surface of a material and then waiting for the heat to conduct to other portions of the material. This is inefficient for materials that do not conduct heat well and materials which cannot withstand very high contact temperatures, as is the case with most plastics and solid fruit pieces.

Ohmic heating involves passing an electrical current directly through a conductive material to be heated. Without stirring, ohmic heating does not necessarily uniformily heat all portions of the material and can overheat localized volumes. Sterilization and cleaning are also difficult because ohmic heating requires a contacting electrode.

Induction heating applies an intense, rapidly alternating magnetic field, to induce an electrical current to flow and cause heating in a material. Induction heating, however, does not work particularly well on non-metallic materials.

Microwave heating has become more popular in recent years, but also has limitations. Microwaves do not necessarily penetrate deeply into materials to be heated and, due to standing waves in the heater, do not penetrate uniformly, again possibly causing localized overheating and undesired flavor degradation in fruit pieces.

Dielectric heating is substantially instantaneous and does not require direct contact between a hot surface and the material to be heated. There is no conventional ohmic current passed through the material, so a material to be heated does not need to be electrically conductive, only capacitively lossy. Unlike the induction heating case, dielectrically heated materials do not need to be metallic. Dielectric heaters operating at radio frequencies, often tens of MHz, produce substantially uniform heating, and thus avoid localized overheating. Radio frequency dielectric heaters do not need complex waveguides or shielding measures, and do not use inefficient magnetron energy sources as do most microwave heaters. Further, generation of significant radio frequency power output is usually more economical than production of an equivalently effective microwave power output.

Dielectric heating is particularly useful in the food processing industry. Foods can be baked, dried, and pasteurized with dielectric heating. Moisture content can be controlled very precisely because water is preferentially heated in dielectric heating systems. When the water evaporates, the electrical energy is no longer efficiently coupled into the food being heated, so heating is self-limiting. Widely used glass and TEFLON® containers are not capacitively lossy at radio frequencies, so RF dielectric heaters are easily adaptable to existing large-scale bulk food processing operations.

Conventional dielectric heaters use vacuum tubes to produce the kilowatts of RF energy needed for commercially useful equipment. Vacuum tubes are fragile, bulky, and failure-prone due to limited operational lifetime. High-power vacuum tubes are very expensive, on the order of $20,000 for a 100 kilowatt tube. These tubes are usually operated in inefficient Class A circuits, and often require elaborate water cooling systems that are cumbersome to maintain. Failure of one of these high-power vacuum tubes usually requires the entire heating system to be shut down for maintenance. A more affordable, reliable, and efficient means for generating RF power for dielectric heating of food products is needed.

SUMMARY OF THE INVENTION

The present invention provides a solid state radio frequency (RF) generator for dielectric heating of food products. In the preferred embodiment, a distributed oscillator comprising an array of solid state devices (e.g., MOSFETs) and a high voltage inductor drives a capacitor to produce an intense alternating electric field. The electric field substantially instantaneously, uniformly, and preferentially heats dielectric materials, preferably food products, moving through the field in a glass pipe. Operators of the heater may observe the process, and may incorporate a number of heating stages into a food processing system having an easily controllable temperature profile.

The use of a large number of individual low-cost low-power devices increases the reliability and ease of maintenance of the generator. Each coil turn of the inductor is shunted by a tuning capacitor to evenly distribute the load across all inductor coil turns. Each coil turn is driven by a set of push-pull series device chains, with each device synchronously driven by individual gate transformers also connected to the coil turn, and with each device shunted by a balancing capacitor to evenly distribute the load across the devices in the chain.

DETAILED DESCRIPTION OF THE PREFERRED EMBODIMENT

The present invention comprises a solid state RF generator for dielectric heating. In the preferred embodiment, food is dielectrically heated by the generator during transportation to destroy bacteria. By replacing a few vacuum tube components with a large number of power MOSFETs, the invention achieves improvements in size, cost, efficiency, reliability, redundancy, scalability, ease of maintenance, and heating precision and control.

Figure 1:
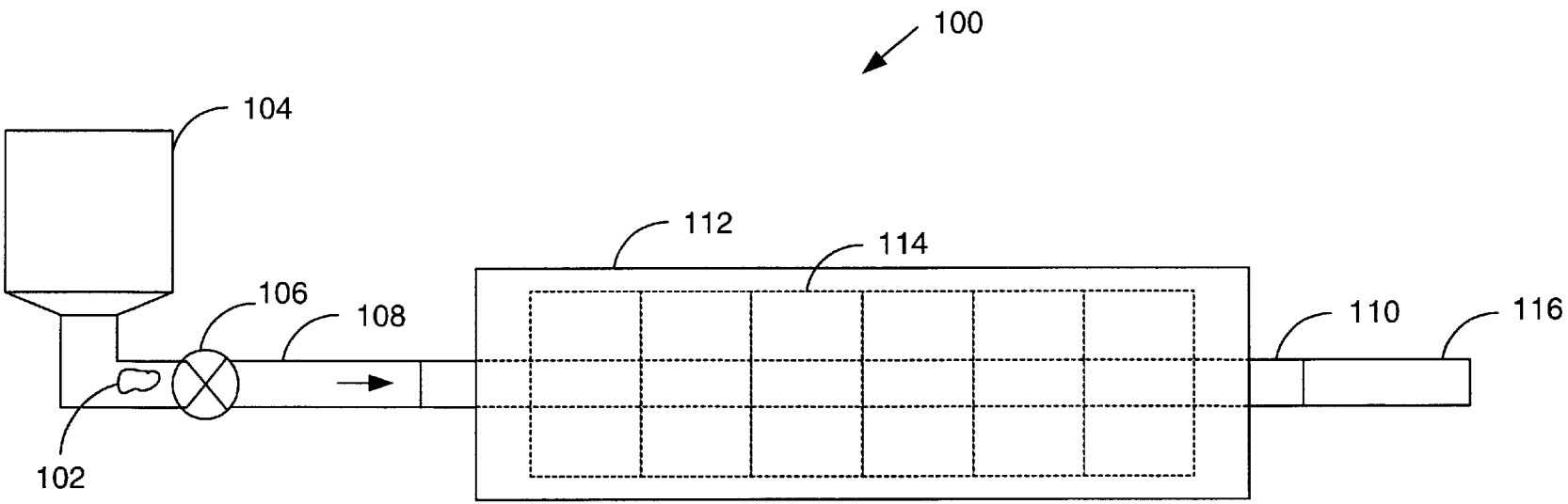
FIG. 1 is an elevation view of one embodiment of a food processing system in accordance with the present invention.

FIG. 1 illustrates one embodiment of a food processing system 100. A product 102 to be heated is pumped by pump 106 from storage container 104 into input pipe 108, which transfers product 102, via heating pipe 110, into heating system 112, which includes a number of heating modules 114. Product 102 may be transported by alternate means, including pressurization of storage container 104, such that pump 106 is unnecessary. The number of heating modules 114 used may be selected based on a number of variables, including the product 102 flow rate, the temperature change required, the product 102 heat capacity, and the heating pipe 110 diameter. Output pipe 116 transfers heated product 102 out of heating system 112 for further processing, such as colorizing, flavorizing, cooling, packaging or serving (not shown).

In the preferred embodiment, heating pipe 110 is a cylindrical glass pipe with an internal diameter of five centimeters. Heating pipe 110 may be of a different diameter or have a non-circular cross-section. Heating pipe 110 may be manufactured of TEFLON® or other material which is not capacitively lossy at the relevant frequency, but glass is preferred because glass is cheaper, transparent and not easily scratched. Glass is also non-porous and thus does not absorb food particles, a fact that enables different products 102 to be processed through the same heating pipe 110 separated by a spacer or "pig" (not shown), and simplifies cleaning. In an alternative embodiment, a conveyor belt may replace heating pipe 110 for transportation of product 102 through heating system 112. In another embodiment, product 102 may be transported through heating system 112 in already-packaged form.

Figure 2:
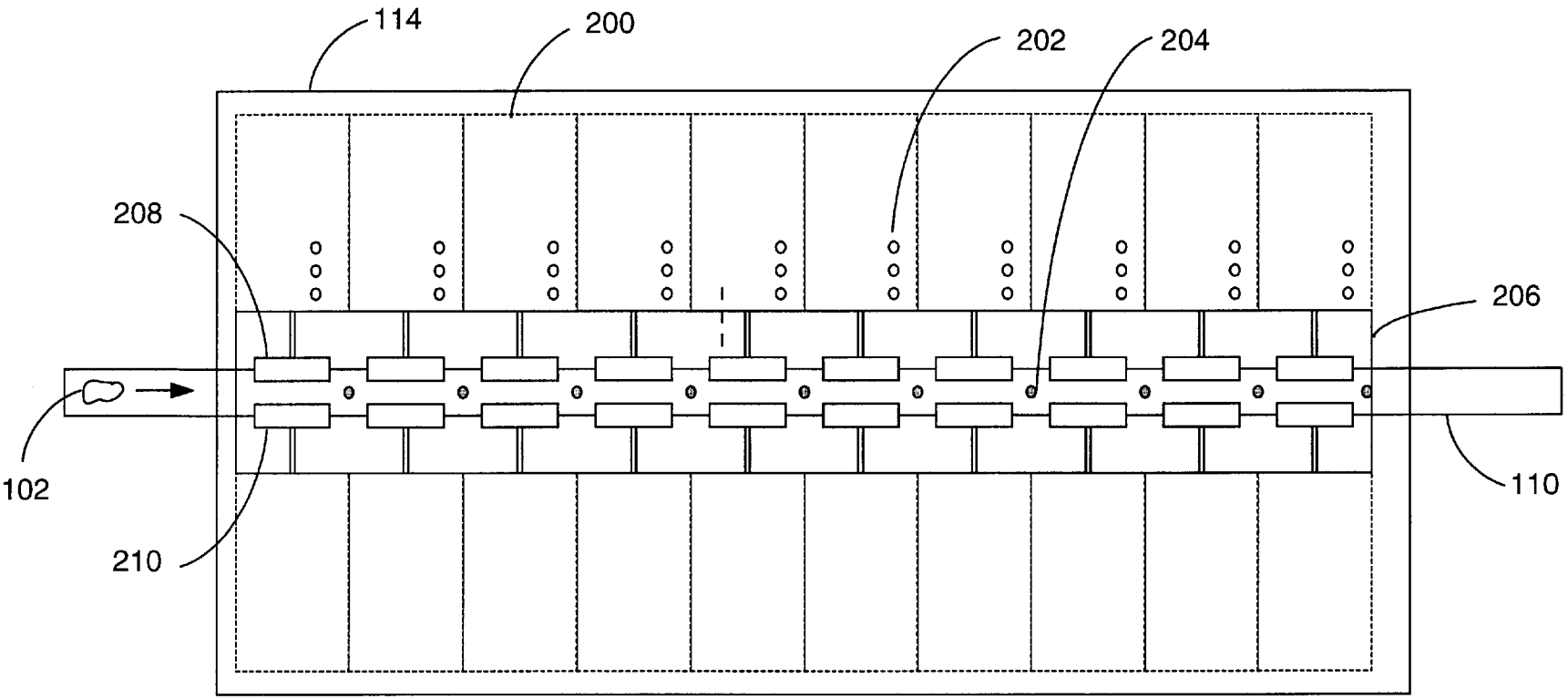
FIG. 2 is a diagram of one embodiment of a heating module in accordance with the invention.

FIG. 2 shows the FIG. 1 heating module 114 in an embodiment preferably two meters long and eighty-five centimeters high, which can handle a total of twenty kilowatts of input electrical power. Each heating module 114 is RF shielded to prevent radiation leakage. Each heating module 114 preferably includes ten heating stages 200, each of which handles two thousand watts of input electrical power. Heating modules 114 of different physical size and electrical power rating may be used for cooking in homes or aboard airplanes.

Status indicators 202 display the operational status of each heating stage 200. Each heating stage 200 also includes a sensor 204, preferably used to measure the temperature of product 102 as it moves through heating pipe 110. In an alternative embodiment, sensor 204 may measure reflected power to determine the net power absorbed by product 102. A screened sight glass 206 allows food processing system 100 operators to observe product 102 as it moves along. The screened sight glass 206 is electrically conductive to prevent radiation leakage. A pair of conductive capacitor plates 208 and 210 is placed around the outer diameter of heating pipe 110. Each pair of plates 208 and 210 is independently driven by the respective heating stage 200. If a particular heating stage 200 fails, the product 102 flow rate, or preferably the power output of other heating stages 200, can be adjusted to compensate until the faulty heating stage 200 is replaced. In a conventional vacuum tube type heating system, any interruption of applied power from the tube due to arcing or tube degradation will compromise the entire batch of product 102 being processed. If any portion of product 102 is not properly pasteurized, then the whole batch must be discarded. In this embodiment, several heating stages 200 can fail completely without compromising the batch.

Figure 3:
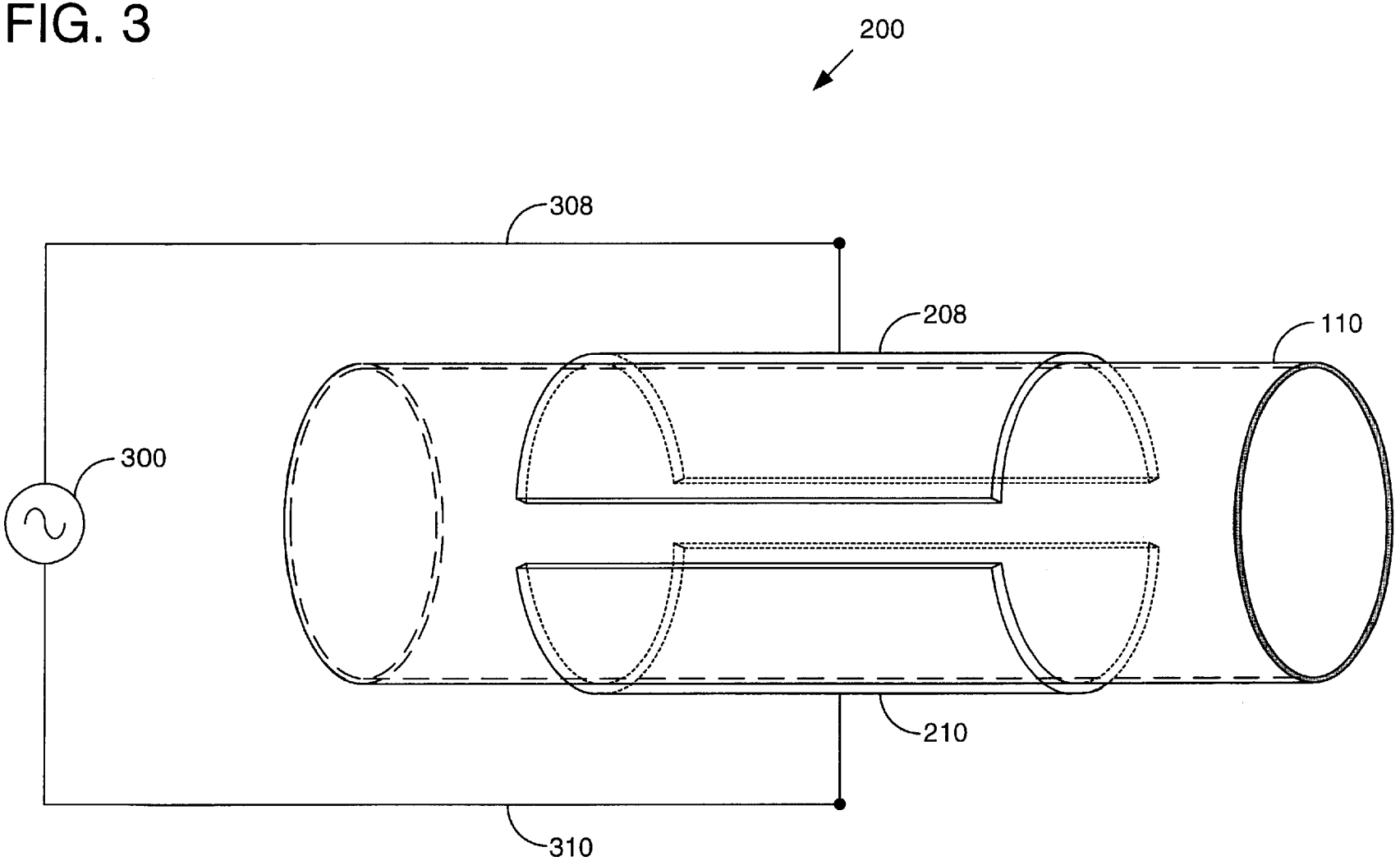
FIG. 3 is a diagram of a heating stage in accordance with the invention.

FIG. 3 shows basic components of one embodiment of heating stage 200, which include an RF power source 300 driving a high-voltage RF signal via conductors 308 and 310 to plates 208 and 210. Plates 208 and 210 are disposed around the exterior of heating pipe 110 to produce an intense, alternating electric field throughout product 102 (not shown) in heating pipe 110. Plates 208 and 210 may be mechanically pressed against the outer surface of heating pipe 110 while product 102 flows through the system and, when necessary for maintenance, mechanically separated to allow replacement of heating pipe 110.

When heating pipe 110 is empty or filled with a product 102 that does not readily absorb RF energy, little or no power is wasted because heating pipe 110 is not capacitively lossy at the frequency applied by RF power source 300. When heating pipe 110 is filled with a product 102 that includes water or polar molecules, product 102 readily absorbs RF energy and is heated substantially uniformly. However, heating stops when the water or other polar molecules evaporate, so overheating is prevented. Sensor 204 further helps prevent overheating.

In the preferred embodiment, RF power source 300 operates at seven MHz. An alternative embodiment may use a frequency of 6.78 MHz, so that most RF harmonics that might leak out will conform with FCC-allocated Industrial, Scientific, and Medical (ISM) frequency constraints. Different radio frequencies may be selected as appropriate for the different product 102 compositions that may be heated. Product 102 preferably includes "fruit preps" which are mixtures of fruits and sweeteners of various concentrations often used in beverages and yogurt. Product 102 may also include "savory" foods, such as meats, meaty sauces, and vegetables.

Figure 4:
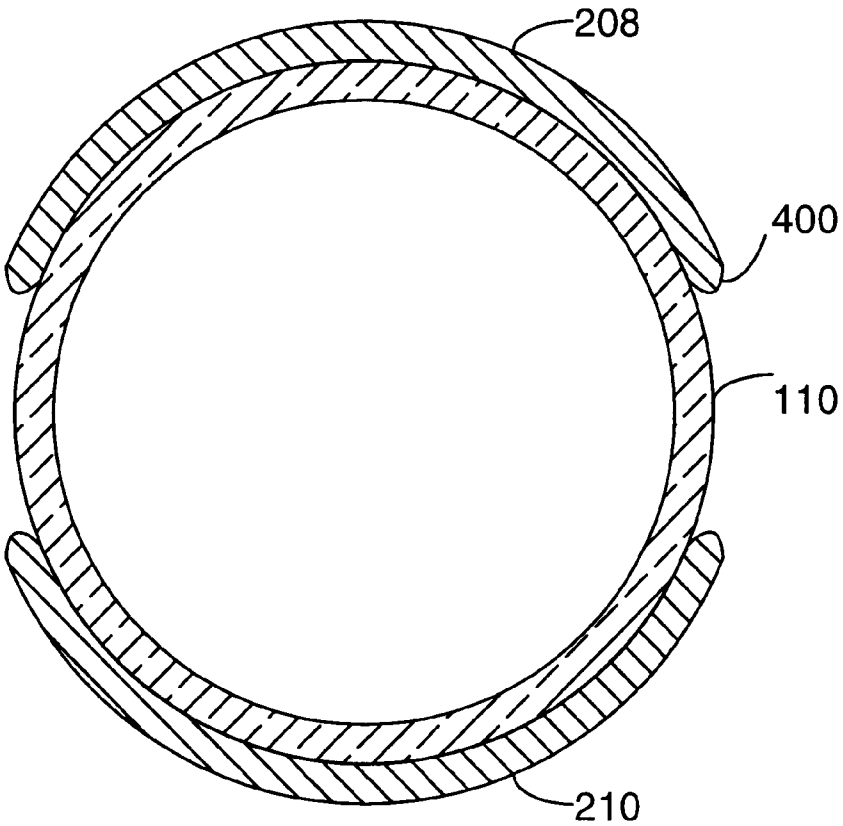
FIG. 4 is a cross-sectional diagram of one embodiment of capacitive plates in accordance with the invention.

FIG. 4 shows a cross-section of one embodiment of plates 208 and 210. Edges 400 of plates 208 and 210 are rounded to prevent sharp electric field gradients that might cause a discharge arc between plates 208 and 210. Similarly, the distance between the edges 400 of opposing plates 208 and 210 is determined by the voltage to be supported by the plates without a discharge arc. Different plate configurations may be used in alternative embodiments. For example, both horizontal and vertical plate pairs may be used to generate electric fields of different spatial orientations for differing product types and power densities.

The approximate power delivered per meter of heating pipe 110 is given by the equation:

$$P=\pi E^2 f \kappa \epsilon_o A \tan(\alpha)$$

where P is the power per unit length ($W/m^2$), $\pi$is the familiar mathematical constant, E is the average peak electric field (V/m), f is the frequency (Hz) of the signal, $\kappa$ is the dielectric constant (typically 55) of the product 102 to be heated, $\epsilon_o$ is the permittivity of free space ($8.85\times10^{-12}$ F/m), A is the cross-sectional area ($m^2$) of heating pipe 110, and tan($\alpha$) is the loss factor (typically 0.1 for water at seven MHz). Experiments with water in a 7.5 centimeter inside diameter heating pipe 110 with 2,000 peak volts at seven MHz applied to plates 208 and 210 resulted in 3,363 watts absorbed per meter of heating pipe 110. An increase to 4,000 peak volts would deliver an estimated 13,450 watts per meter of heating pipe 110 under these conditions.

Figure 5:
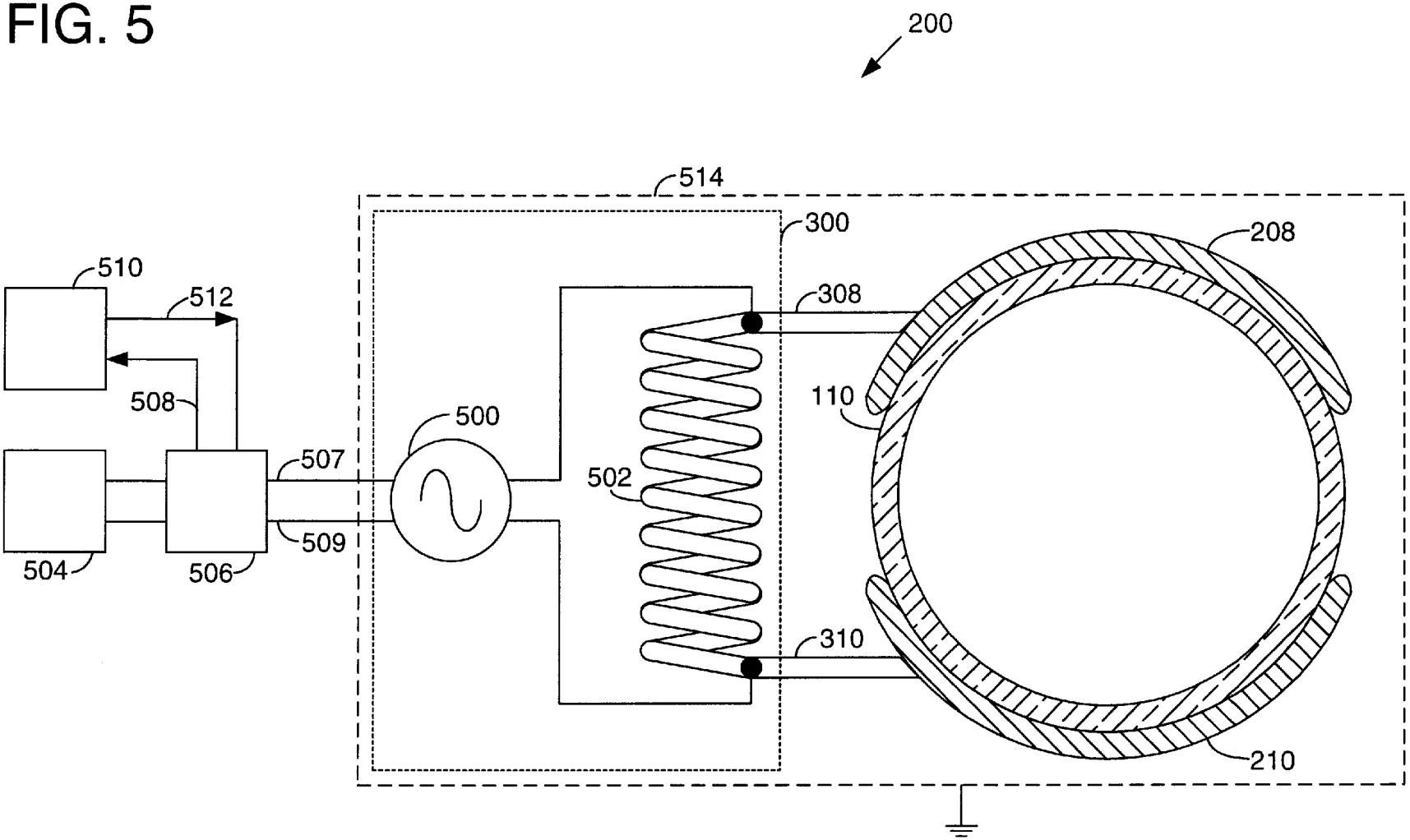
FIG. 5 is a circuit diagram of one embodiment of an RF power source including a solid state RF generator in accordance with the invention.

FIG. 5 shows one embodiment of RF power source 300 in a typical heating stage 200. RF power source 300 includes solid state RF generator 500 and a high-voltage air core inductor 502. Solid state RF generator 500, as will be described below, actually includes a number of components and is not a single oscillator. An alternative embodiment may use a transformer instead of a single inductor 502.

Three-phase commercial AC power is supplied to an AC bridge rectifier 504, which in turn powers a DC—DC converter 506; rectifiers 504 and DC—DC converters 506 are well known in the art. In the event of a power fault, DC—DC converter 506 may transmit a fault signal on line 508 to a computer interface 510. Computer interface 510, via an analog control signal on line 512, controls the power delivered by DC—DC converter 506 to RF power source 300. In the preferred embodiment, one heating module 114 includes one three-phase AC bridge rectifier 504, one DC—DC converter 506, one computer interface 510, and ten heating stages 200. Grounded RF shield 514 encloses heating stages 200 to prevent radiation of RP energy and operator exposure to high voltages. FIG. 2 status indicators 202 and sensor 204 are also connected to computer interface 510, but those connections are omitted here for clarity.

Computer interface 510 can thus monitor and control the power delivered by each heating stage 200 to product 102, so that a particular temperature increase rate and temperature profile can be applied to product 102 as it moves through heating pipe 110. Destruction of bacteria within product 102 is a function of the applied electric field, temperature increase rate, and temperature hold time. A particular combination of these factors can therefore be selected for maximum sterilization effectiveness and minimum detrimental impact on product 102. Computer interface 510 can increase the power output of various heating stages 200 to compensate for power deficiencies due to any faulty heating stages 200. Computer interface 510 can also signal when a particular heating stage 200 requires maintenance.

Figure 6:
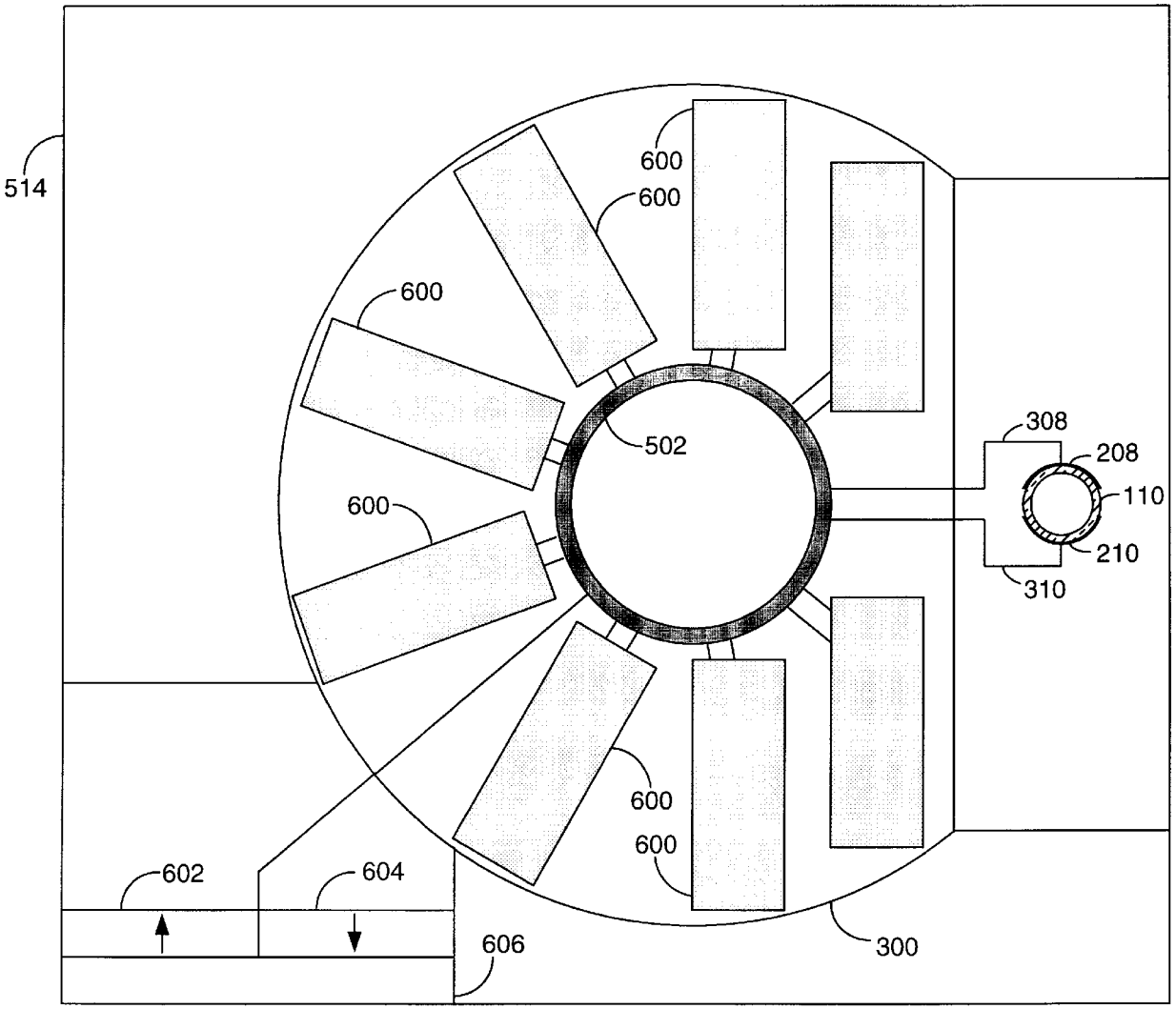
FIG. 6 is a cross-sectional diagram of one embodiment of a heating stage including an RF power source in accordance with the invention.

FIG. 6 shows a cross-section of one embodiment of a heating stage 200 including an RF power source 300 having a number of circuit cards 600 instead of a single oscillator. Inductor 502 is preferably positioned horizontally. A number of circuit cards 600, preferably eight, are connected to inductor 502, with one circuit card 600 attached to approximately one coil (a 360' turn) of inductor 502. Each circuit card 600 contains RF power generation circuitry, as will be described below. Fans 602 and 604 circulate cooling air through RF power source 300. Heat exchanger 606 preferably removes heat from the circulating air for discharge into a circulating water system (not shown). Most conventional dielectric heaters include vacuum tubes that already require water cooling, so inclusion of heat exchanger 606 poses no additional burden.

Each heating stage 200 operates substantially independently from other heating stages 200 and can be replaced relatively quickly if necessary. Failure of any particular circuit card 600 will not result in the overall failure of RF power source 300 in heating stage 200 however, because each circuit card 600 operates substantially independently from other circuit cards 600. Any circuit card 600 can be replaced quickly, or can be left in heating stage 200 until scheduled shutdown and repair occurs, or until more circuit cards 600 fail and cause heating stage 200 to fail altogether. Unlike food processing systems including a few very high-power vacuum tubes, the invention has no single point failure modes wherein product 102 flow must be halted in an unscheduled manner due to failure of any single part of the system.

Heating pipe 110 is preferably positioned horizontally, but in alternative embodiments heating pipes 110 may be oriented vertically or interconnected in any convenient manner with (FIG. 1) input pipes 108 and output pipes 116.

Figure 7:
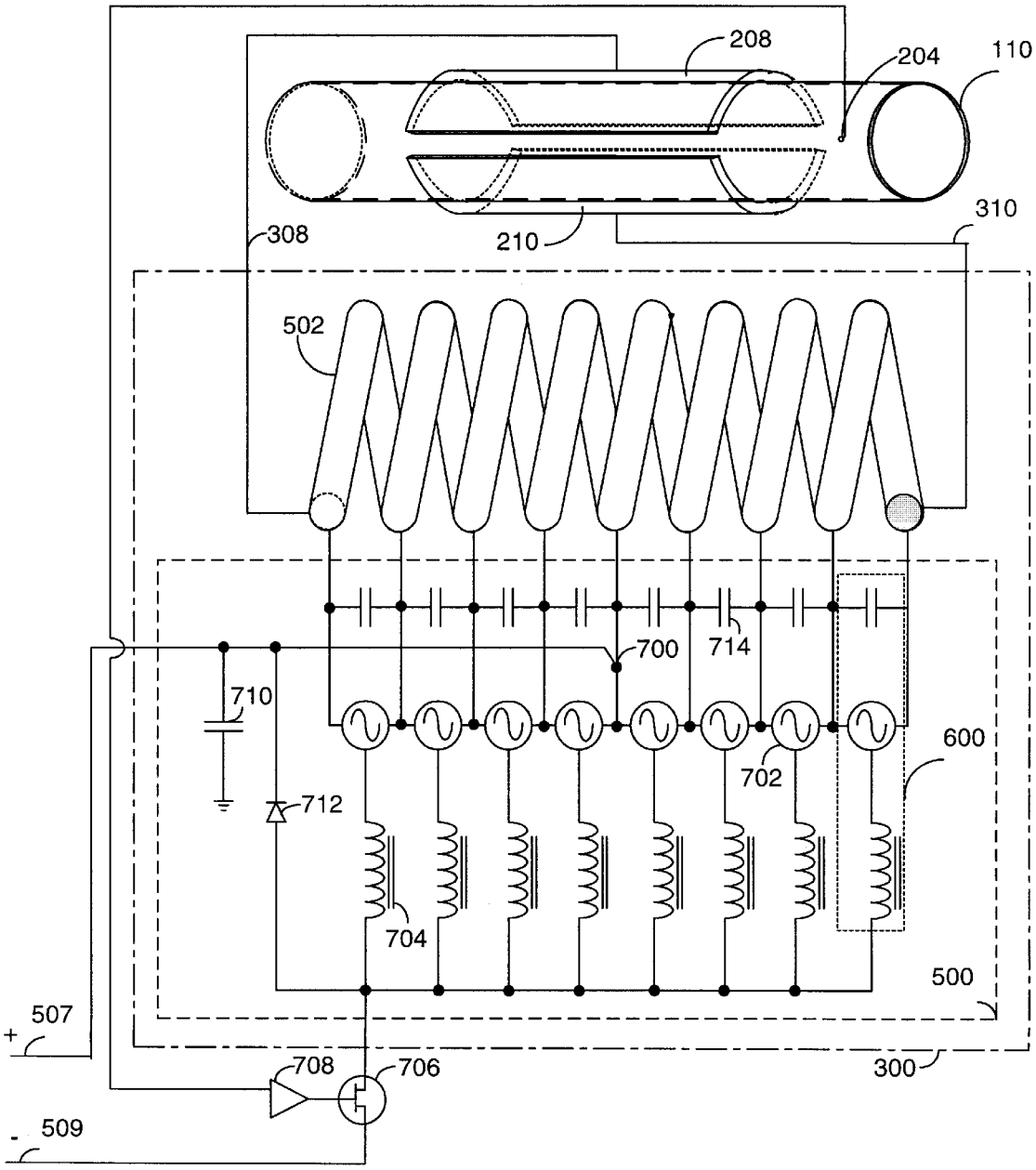
FIG. 7 is a circuit diagram of one embodiment of a solid state RF generator in accordance with the invention.

FIG. 7 shows one embodiment of solid state RF generator 300. Direct current from DC—DC converter 506 is applied via line 507 to center tap 700 of inductor 502 and flows into each circuit card 600. Grounding capacitor 710 helps ensure that generated RF power is distributed equally to each half of inductor 502. Each circuit card 600 includes an oscillator segment 702 and an RF choke 704. Each oscillator segment 702 preferably drives one coil of inductor 502 with RF energy. Coil tuning capacitors 714 are placed across each inductor 502 coil to equalize the resonant frequencies of oscillator segments 702. Power should be distributed evenly through each inductor 502 coil by each oscillator segment 702 at one resonant frequency to maximize power efficiency and oscillator segment 702 reliability. Direct current flows through each RF choke 704 and out through a current-limiting buck converter 706. Buck converters 706 are well known in the art, being used commonly in resonant power supplies. The DC bias supplied by buck converter 706 determines the amount of RF energy produced by each oscillator segment 702. In response to signals from sensor 204 and computer interface 510 (not shown), controller 708 controls the output of buck converter 706 to regulate the power applied to product 102 as it flows through heating pipe 110. When buck convertor 706 turns off, diode 712 discharges RF chokes 704.

Figure 8:
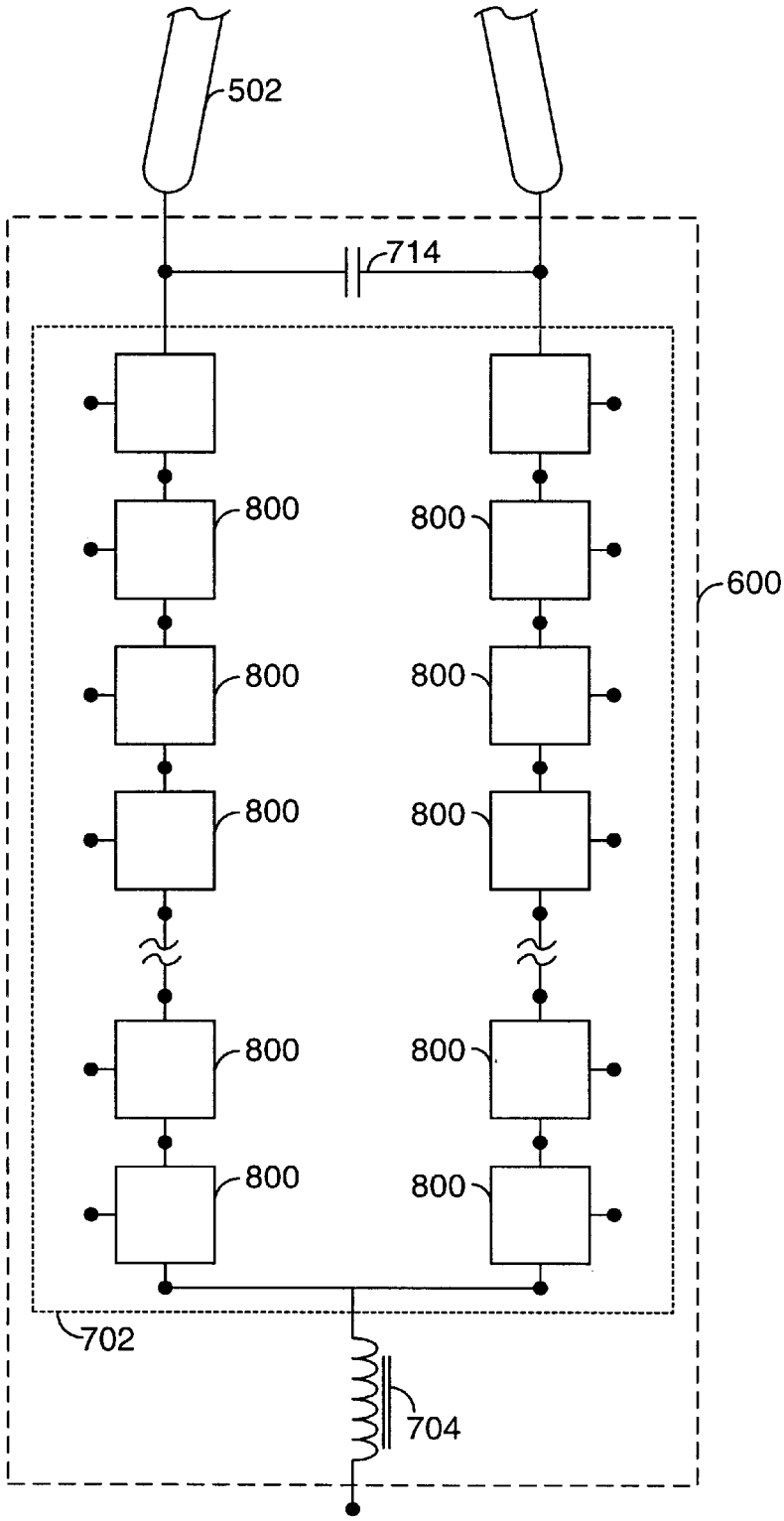
FIG. 8 is a circuit diagram of one embodiment of an oscillator segment in accordance with the invention.

FIG. 8 shows one embodiment of an oscillator segment 702, each of which includes a number of driver cells 800 arranged in a push-pull chain inverter. Each driver cell 800 connected in a series chain connected to one end of an inductor 502 coil should be switched completely on (operated nonlinearly, versus Class A operation) substantially simultaneously. Driver cells 800 in opposing series chains in each oscillator segment 702 should be switched on substantially alternately, to achieve the push-pull action that energizes each inductor 502 coil by each series chain in sequence.

The preferred embodiment has ten driver cells 800 in each series chain driving each end of each inductor 502 coil. The voltage of each inductor 502 coil is distributed equally over the preferably identical driver cells 800 in a series chain, so that no single driver cell 800 need withstand the entire coil operating voltage alone. In the event a particular driver cell 800 fails in an open-circuit manner, the full inductor 502 operating voltage should be high enough to cause a reverse breakdown of the driver cell device (to be described further below) junctions in each failed driver cell 800. The result is effectively a forced short-circuit failure, which leaves the remaining driver cells 800 in a series chain still working, but with a slightly higher operating voltage. The operating voltage of each inductor 502 coil, the voltage rating of each driver cell 800, and the degree of redundancy desired determine the number of driver cells 800 needed in each series chain.

The entire heating stage 200 should resonate if each driver cell 800 is identical, because each inductor 502 coil and each balancing capacitor 714 combination is tuned to the same resonant frequency, and because each inductor 502 coil shares a magnetic flux linkage with a neighboring coil. If in an alternative embodiment inductor 502 is actually only one half of a high voltage transformer, driver cells 800 can be of lower voltage rating but must conduct proportionately larger currents. Further, high voltage transformers will cause some loss of power efficiency.

Figure 9:
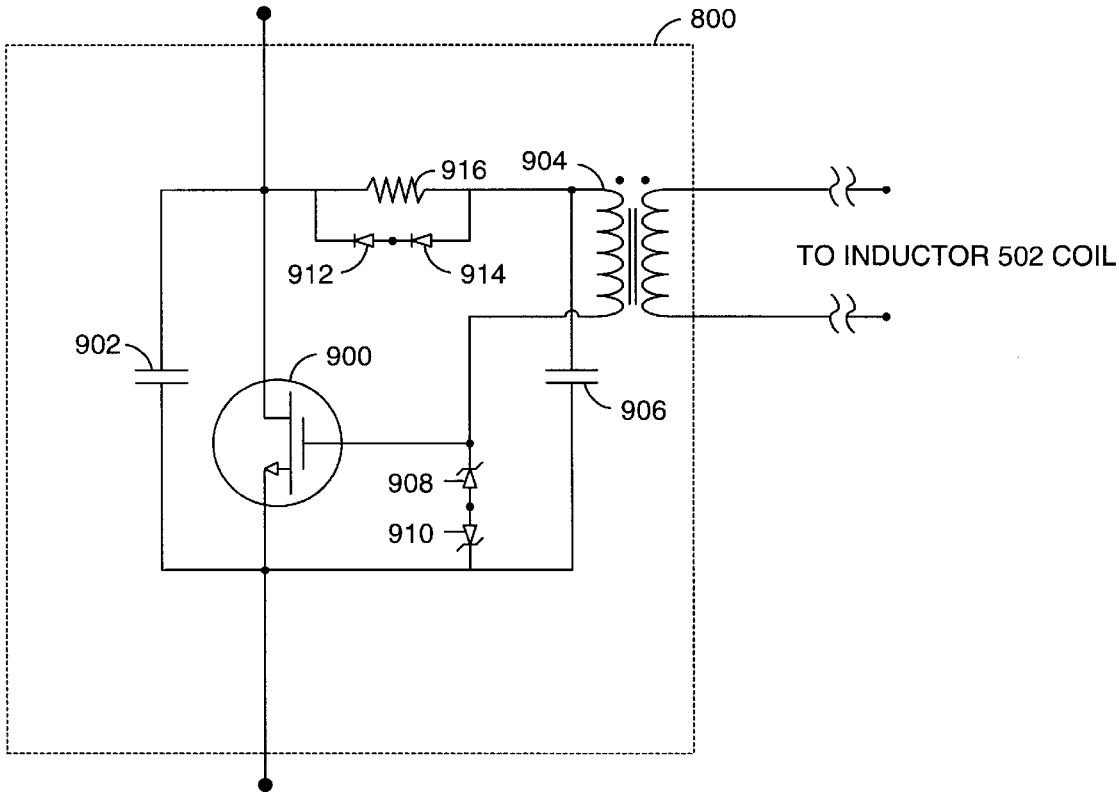
FIG. 9 is a diagram of one embodiment of a self-biasing driver cell in accordance with the invention.

FIG. 9 shows one embodiment of a self-biasing driver cell 800. In the preferred embodiment, each driver cell device 900 is a power MOSFET. The advent of low-cost high-voltage power MOSFETs enables the use of a reliable and inexpensive distributed power generator based on many such devices. Each power MOSFET used in the preferred embodiment is housed in a TO-220 type package and costs less than a dollar. Each power MOSFET can preferably dissipate about two watts of heat with an inexpensive heat sink while supplying approximately ten watts of RF power to the load, for a measured power efficiency of approximately 85%. Typical vacuum tube based systems have power efficiencies of only 50% to 60%. In alternative embodiments, other switching devices such as bipolar junction transistors may be used.

Each driver cell device 900 is shunted by a driver cell balancing capacitor 902 to help reduce the effect of variations in driver cell device 900 switching characteristics. A small gate drive transformer 904 provides a scaled-down inductor 502 coil voltage to trigger conduction of driver cell device 900. Trigger capacitor 906, Zener diodes 908 and 910, diodes 912 and 914, and a ten kilohm resistor 916 complete the self-biasing driver cell 800. Alternative embodiments may use different circuits to synchronize driver cell device 900 conduction and to limit the excursion of driver cell device 900 operating voltages.

While the invention has been described with reference to a specific embodiment, the description is intended for purposes of illustration only and should not be construed in a limiting sense. Various modifications of and changes to the disclosed embodiment, as well as other embodiments of the invention, will be apparent to those of ordinary skill in the art, and may be made without departing from the true spirit of the invention. For example, the invention may be used where a reliable radio transmitter is required, such as in navigational buoys, satellites, or in combat equipment. Similarly, the invention may be used separately or in combination with other heating methods in clothes dryers or in the manufacture of tires. It is therefore contemplated that the language of the following claims will cover any such modifications or embodiments that fall within the true scope of the invention.

What is claimed is:

1. A solid-state radio frequency generator apparatus comprising:

an oscillator;

a high-voltage inductor electrically connected directly to said oscillator; and a plurality of capacitive plates including a first plate and a second plate electrically connected directly to said inductor for producing an alternating electric field capable of heating material between said first plate and said second plate;

wherein said oscillator produces a potential across coils of said high-voltage inductor.

2. The apparatus of claim 1 wherein said high-voltage inductor comprises one winding of a high-voltage transformer.

3. A solid-state radio frequency generator apparatus comprising:

a distributed oscillator;

a high-voltage inductor connected to said distributed oscillator; and a plurality of capacitive plates connected to said inductor for producing an alternating electric field between said capacitive plates;

wherein said high-voltage inductor includes a plurality of windings and a plurality of coil-balancing capacitors each connected across a respective one of said windings.

4. The apparatus of claim 1 further comprising at least one connected buck convertor and at least one connected sensor which control said alternating electric field.

5. The apparatus of claim 1 wherein said distributed oscillator comprises a plurality of connected substantially synchronously-switched independent inverter subcircuits.

6. The apparatus of claim 5 wherein each of said inverter subcircuits comprises a plurality of substantially synchronously-switched independent driver cells arranged in connected push-pull series chains.

7. The apparatus of claim 6 wherein said driver cells comprise a plurality of driver cell devices.

8. The apparatus of claim 7 wherein said driver cell devices comprise power MOSFETs.

9. A solid-state radio frequency generator apparatus comprising:

a distributed oscillator;

a high-voltage inductor connected to said distributed oscillator; and a plurality of capacitive plates connected to said inductor for producing an alternating electric field between said capacitive plates;

wherein said distributed oscillator includes a plurality of connected substantially synchronously-switched independent inverter subcircuits, each of said inverter subcircuits includes a plurality of substantially synchronously-switched independent driver cells arranged in connected push-pull series chains, and said driver cells include self-biasing transformer-coupled diode-limited nonlinear switching circuits with connected driver cell balancing capacitors and a plurality of connected driver cell devices.

10. The apparatus of claim 1 wherein said alternating electric field heats by dielectric absorption a target material disposed between said capacitive plates.

11. The apparatus of claim 10 further comprising a tube, disposed between said capacitive plates, through which said target material can be moved as said alternating electric field heats said target material.

12. The apparatus of claim 10 further comprising a conveyor belt, disposed between said capacitive plates, on which said target material moves as said alternating electric field heats said target material.

13. The apparatus of claim 10 wherein said heating by dielectric absorption occurs at a sufficient temperature and for a sufficient time to destroy pathogens within said target material.

14. The apparatus of claim 10 wherein said target material comprises a food item.

15. The apparatus of claim 14 wherein said target material comprises a sweet food item.

16. The apparatus of claim 15 wherein said target material comprises a fruit preparation.

17. The apparatus of claim 14 wherein said target material comprises a flavoring.

18. The apparatus of claim 14 wherein said target material comprises a beverage concentrate.

19. The apparatus of claim 14 wherein said target material comprises a savory food item.

20. The apparatus of claim 14 wherein said target material comprises a dairy product.

21. A method of generating radio frequency energy, comprising the steps of:

supplying input power to a solid-state oscillator to produce a potential;

operating said solid-state oscillator to apply said potential across a high-voltage inductor to directly drive said high-voltage inductor to produce an alternating magnetic field; and using said high-voltage inductor to resonantly drive a number of capacitive plates including a first plate and a second plate to produce an alternating electric field capable of heating material between said first plate and said second plate.

22. The method of claim 21 wherein said high-voltage inductor is used as one winding of a high-voltage transformer for driving said capacitive plates.

23. A method of generating radio frequency energy comprising the steps of:

supplying input power to a solid-state distributed oscillator;

operating said solid-state distributed oscillator to drive a high-voltage inductor to produce an alternating magnetic field;

using said high-voltage inductor to resonantly drive a number of capacitive plates to produce an alternating electric field between said capacitive plates; and tuning said high-voltage inductor with a plurality of coil-balancing capacitors.

24. The method of claim 21 comprising the further step of using a plurality of buck convertors and a plurality of sensors to control said input power and said alternating electric field.

25. The method of claim 21 comprising the further step of substantially synchronously switching a plurality of independent inverter subcircuits to drive said high-voltage inductor and said capacitive plates.

26. The method of claim 25 comprising the further step of substantially synchronously switching a plurality of independent driver cells arranged in push-pull series chains to distribute voltage over said plurality of independent driver cells.

27. The method of claim 26 comprising the further step of distributing said driver cells over a plurality of driver cell devices.

28. The method of claim 27 wherein said driver cell devices comprise power MOSFETs.

29. A method of generating radio frequency energy, comprising the steps of:

supplying input power to a solid-state distributed oscillator;

operating said solid-state distributed oscillator to drive a high-voltage inductor to produce an alternating magnetic field;

using said high-voltage inductor to resonantly drive a number of capacitive plates to produce an alternating electric field between said capacitive plates;

substantially synchronously switching a plurality of independent inverter subcircuits to drive said high-voltage inductor and said capacitive plates;

substantially synchronously switching a plurality of independent driver cells arranged in push-pull series chains to distribute voltage over said plurality of independent driver cells; and switching a plurality of driver cell devices, having self-biasing transformer-coupled diode-limited nonlinear switching circuits with driver cell balancing capacitors to ensure switching synchronicity.

30. The method of claim 21 comprising the further step of heating a target material by dielectric absorption of said alternating electric field between said capacitive plates.

31. The method of claim 30 comprising the further step of moving said target material through a tube as said alternating electric field heats said target material.

32. The method of claim 30 comprising the further step of moving said target material on a conveyor belt as said alternating electric field heats said target material.

33. The method of claim 30 wherein said heating of said target material occurs at a sufficient temperature and for a sufficient time to destroy pathogens present in said target material.

34. The method of claim 30 wherein said target material comprises a food item.

35. The method of claim 34 wherein said target material comprises a sweet food item.

36. The method of claim 35 wherein said target material comprises a fruit preparation.

37. The method of claim 34 wherein said target material comprises a flavoring.

38. The method of claim 34 wherein said target material comprises a beverage concentrate.

39. The method of claim 34 wherein said target material comprises a savory food item.

40. The method of claim 34 wherein said target material comprises a dairy product.

41. A solid-state radio frequency generator system, comprising:

means for supplying controlled input power to a solid-state distributed oscillator;

means for synchronously driving coils of a high-voltage inductor with a solid-state distributed oscillator to produce an alternating magnetic field; and means for resonantly driving a number of capacitive plates with said high-voltage inductor to produce an alternating electric field.

42. A solid-state radio frequency generator system, comprising:

a supply assembly supplying controlled input power to a solid-state oscillator;

a synchronous coil drive assembly synchronously driving coils of a high-voltage inductor with a solid-state oscillator to produce an alternating magnetic field; and a resonant drive assembly resonantly driving a number of capacitive plates with said high-voltage inductor to produce an alternating electric field.

43. A method of generating radio frequency fields using a solid-state device, comprising:

supplying controlled input power to a solid-state oscillator;

synchronously driving coils of a high-voltage inductor with a solid-state oscillator to produce an alternating magnetic field; and resonantly driving a number of capacitive plates with said high-voltage inductor to produce an alternating electric field.

44. The apparatus of claim I further comprising:

a plurality of said oscillators;

a plurality of high voltage inductors, driven by said plurality of oscillators; and a plurality of capacitors, each capacitor having a pair of capacitive plates, a first plate of said pair being connected to a first end of a high voltage inductor and a second plate of said pair being connected to a second end of the same high voltage inductor, forming an alternating electric field between said pair of capacitive plates for heating.

45. The method of claim 21 wherein:

said step of supplying further includes supplying voltage to a plurality of oscillators;

said step of operating further includes operating a plurality of high voltage inductors; and said step of using further includes using said plurality of high-voltage inductors to resonantly drive a plurality of capacitors each having a pair of capacitive plates, a first plate of said pair being connected to a first end of a high voltage inductor and a second plate of said pair being connected to a second end of the same high voltage inductor, forming an alternating electric field between said pair of capacitive plates for heating.

* * * * *